US006402976B1

(12) United States Patent
Wahle et al.

(10) Patent No.: US 6,402,976 B1
(45) Date of Patent: Jun. 11, 2002

(54) TEXTILE FINISHING AGENT

(75) Inventors: Bernd Wahle, Kaarst; Guenter Uphues, Monheim; Yvonne Reichert, Krefeld, all of (DE); Rafael Pi Subirana, Granollers; Terese Copete Vidal, Sabadell, both of (ES)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/242,424

(22) PCT Filed: Aug. 7, 1997

(86) PCT No.: PCT/EP97/04304

§ 371 (c)(1),
(2), (4) Date: May 17, 2000

(87) PCT Pub. No.: WO98/07920

PCT Pub. Date: Feb. 26, 1998

(30) Foreign Application Priority Data

Aug. 16, 1996 (DE) ..... 196 33 104

(51) Int. Cl.[7] ..... D06M 13/473; D06M 13/463

(52) U.S. Cl. ..... 252/8.61; 252/8.62; 252/8.63; 252/8.81; 252/8.83

(58) Field of Search ..... 252/8.61, 8.62, 252/8.63, 8.81, 8.83

(56) References Cited

U.S. PATENT DOCUMENTS

| | | | | | |
|---|---|---|---|---|---|
| 3,915,867 | A | | 10/1975 | Kang et al. | 252/8.8 |
| 4,149,978 | A | | 4/1979 | Goffinet | 252/8.8 |
| 4,370,272 | A | | 1/1983 | Wechsler et al. | 260/404 |
| 4,937,008 | A | | 6/1990 | Yamamura et al. | 252/8.8 |
| 5,180,508 | A | * | 1/1993 | Birkhan et al. | 510/522 |
| 5,342,961 | A | | 8/1994 | Uphues et al. | 548/352.1 |
| 5,443,631 | A | | 8/1995 | Brock et al. | 106/244 |
| 5,482,636 | A | | 1/1996 | Brock et al. | 252/8.8 |
| 5,545,350 | A | * | 8/1996 | Baker et al. | 510/517 |
| 5,591,186 | A | | 1/1997 | Wurster et al. | 606/170 |
| 5,652,206 | A | * | 7/1997 | Bacon et al. | 510/101 |
| 5,916,863 | A | * | 6/1999 | Iacobucci et al. | 510/329 |

FOREIGN PATENT DOCUMENTS

| | | | |
|---|---|---|---|
| DE | 39 04 754 | | 8/1989 |
| DE | 40 20 271 | | 1/1992 |
| DE | 40 38 983 | | 6/1992 |
| DE | 41 16 648 | | 11/1992 |
| DE | 42 43 862 | | 6/1994 |
| DE | 4313085 | * | 10/1994 |
| EP | 0 239 910 | | 10/1987 |
| EP | 0 293 955 | | 12/1988 |
| EP | 0 295 739 | | 12/1988 |
| EP | 0 309 052 | | 3/1989 |
| EP | 0 431 652 | | 6/1991 |
| EP | 0 607 772 | | 7/1994 |
| GB | 2260771 | * | 4/1993 |
| KR | 9 406 256 B | | 7/1994 |
| WO | WO91/01295 | | 2/1991 |

OTHER PUBLICATIONS

O. Ponsati, et al., C.R. CED–Kongress, Barcelona (1992), pp. 167–179 (No Month).

R. Puchta, "A New Generation of Softeners", Tenside Surf. Det. 30, Carl Hanser Verlag, München (1993), pp. 186, 188 & 190 (No Month).

M. Brock, "Neue Entwicklungen auf dem Gebiet der Waescheweichspueler", Tenside Surf. Det. 30, Carl Hanser Verlag, München (1993), pp. 394–399 (No Month).

R. Lagerman, et al., "Synthesis and Performance of Ester Quaternary Biodegradable Softeners", J. Am. Oil Chem. Soc., 71, No. 1, (Jan. 1994).

Patents Abstracts of Japan, C–749, Aug. 17, 1990, vol. 14/No. 382, JP 63–294316, Kao Corp.

* cited by examiner

*Primary Examiner*—Anthony Green
(74) *Attorney, Agent, or Firm*—John E. Drach; Steven J. Trzaska

(57) ABSTRACT

A textile finish composition containing: (a) an esterquat; and (b) a quatemized fatty acid imidazoline.

17 Claims, No Drawings

TEXTILE FINISHING AGENT

BACKGROUND OF THE INVENTION

This invention relates to new formulations for finishing flat textiles based on esterquats and quatemized fatty acid imidazolines and to their use for conditioning fabrics and stabilizing them against yellowing.

The finishing of yarns and fabrics to the final textiles involves a complex requirement profile. The most important property which finishes are expected to show consists in providing textiles with a pleasant soft feel. Cationic surfactants are generally used for this purpose. Among these, esterquats are particularly important by virtue of their favorable ecological compatibility. Conditioning can be carried out both as a textile pretreatment and as an aftertreatment. Another requirement is to protect textiles against soiling, for which purpose polymers of the so-called "soil repellant" type are added to standard laundry aftertreatment products. A third important aspect is the stabilizing of fabrics against the effect of ozone which, in the case of blue denim in particular, leads very easily to yellowing. However, conventional conditioners do not satisfactorily meet this requirement.

Accordingly, the problem addressed by the present invention was to provide new conditioners which would enable flat textiles, i.e. yarns, woven fabrics and finished textiles, but especially blue denim cloth and jeans produced therefrom, to be given a pleasant soft feel and, at the same time, to be finished against yellowing.

BRIEF SUMMARY OF THE INVENTION

The present invention relates to textile finishes containing (a) esterquats and (b) quaternized fatty acid imidazolines.

DETAILED DESCRIPTION OF THE INVENTION

It has surprisingly been found that mixtures of esterquats and quaternized fatty acid imidazolines not only provide flat textiles and, preferably, blue denim cloth with a pleasant soft feel, they also reliably stabilize them against yellowing, particularly when the fatty acid part of component (b) is derived from oleic acid.

Esterquats

"Esterquats" are generally understood to be quaternized fatty acid triethanolamine ester salts. They are known compounds which may be obtained by the relevant methods of preparative organic chemistry, cf. International patent application WO 91/01295 (Henkel), in which triethanolamine is partly esterified with fatty acids in the presence of hypophosphorous acid, air is passed through the reaction mixture and the whole is then quaternized with dimethyl sulfate or ethylene oxide. U.S. Pat. Nos. 3,915,867, 4,370.272, EP-A2 0 239 910, EP-A2 0 293 955 A2, EP-A2 0 295 739 and EP-A2 0 309 052 A2 are cited here as representative of the extensive prior-art literature. Overviews of this subject have been published, for example, by O. Ponsati in C.R. CED Congress, Barcelona, 1992, p. 167, by R. Puchta et al. in Tens. Surf. Det., 30, 186 (1993), by M. Brock in Tens. Surf. Det., 30, 394 (1993) and by R. Lagerman et al. in J. Am. Oil Chem. Soc., 71, 97 (1994).

The quaternized fatty acid triethanolamine ester salts correspond to formula (I):

(I)

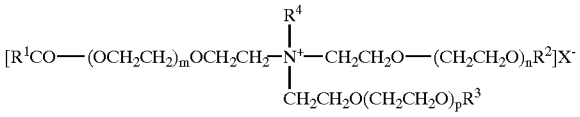

in which $R^1CO$ is an acyl group containing 6 to 22 carbon atoms, $R^2$ and $R^3$ independently of one another represent hydrogen or have the same meaning as $R^1CO$, $R^4$ is an alkyl group containing 1 to 4 carbon atoms or a $(CH_2CH_2O)_qH$ group, m, n and p together stand for 0 or numbers of 1to 12, q is a number of 1 to 12 and X is halide, alkyl sulfate or alkyl phosphate. Typical examples of esterquats which may be used in accordance with the present invention are products based on caproic acid, caprylic acid, capric acid, lauric acid, myristic acid, palmitic acid, isostearic acid, stearic acid, oleic acid, elaidic acid, arachic acid, behenic acid and erucic acid and the technical mixtures thereof obtained, for example, in the pressure hydrolysis of natural fats and oils. Saturated or predominantly saturated fatty acids, for example tallow or palm oil fatty acid, are preferably used. To produce the quaternized esters, the fatty acids and the triethanolamine may be used in a molar ratio of 1.1:1 to 3:1. With the performance properties of the esterquats in mind, a ratio of 1.2:1 to 2.2:1 and preferably 1.5:1 to 1.9:1 has proved to be particularly advantageous. The preferred esterquats are technical mixtures of mono-, di- and triesters with an average degree of esterification of 1.5 to 1.9 and are derived from tallow fatty acid. In performance terms, quatemized fatty acid triethanolamine ester salts corresponding to formula (I), in which $R^1CO$ is the acyl group of tallow fatty acid, $R^2$ has the same meaning as $R^1CO$, $R^3$ is hydrogen, $R^4$ is a methyl group, m, n and p stand for O and X stands for methyl sulfate, have proved to be particularly advantageous.

Besides the quaternized fatty acid triethanolamine ester salts, other suitable esterquats are quaternized ester salts of fatty acids with diethanol-alkyamines corresponding to formula (II):

(II)

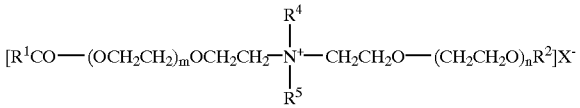

in which $R^1CO$ is an acyl group containing 6 to 22 carbon atoms, preferably an acyl group derived from tallow fatty acid, $R^2$ is hydrogen or has the same meaning as $R^1CO$, $R^4$ and $R^5$ independently of one another are alkyl groups containing 1 to 4 carbon atoms, m and n together stand for O or numbers of 1 to 12 and X stands for halide, alkyl sulfate or alkyl phosphate.

Finally, another group of suitable esterquats are the quaternized ester salts of fatty acids with 1,2-dihydroxypropyl dialkylamines corresponding to formula (III):

(III)

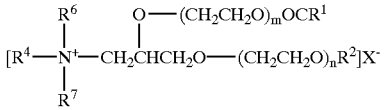

in which $R^1CO$ is an acyl group containing 6 to 22 carbon atoms, preferably an acyl group derived from the fatty acid mixture containing tallow fatty acid, $R^2$ is hydrogen or has the same meaning as $R^1CO$, $R^4$, $R^6$ and $R^7$ independently of one another are alkyl groups containing 1 to 4 carbon atoms, m and n together stand for O or numbers of 1 to 12 and X stands for halide, alkyl sulfate or alkyl phosphate.

So far as the optimal degree of esterification is concerned, the examples mentioned for (I) also apply to the esterquats corresponding to formulae (II) and (III). The esterquats are normally marketed in the form of 50 to 90% by weight solutions in alcohol which may readily be diluted as required with water.

Quaternized fatty acid imidazolines are also known cationic surfactants which are normally obtained by condensation of fatty acids with diamines, preferably ethylenediamines, and subsequent quaternization with alkyl halides or dialkyl sulfates. Processes for producing the imidazolines and their quaternization products are known, for example, from German references DE-A1 40 20 271, DE-A1 40 38 983 and DE-A1 41 16 648 (Henkel). The imidazolines may also contain open-chain hydrolysis products. However, they normally correspond to the following formula:

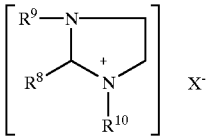

in which $R^8$ is an alkyl and/or alkenyl group containing 7 to 21 carbon atoms and preferably 11 to 17 carbon atoms, $R^9$ represents optionally hydroxysubstituted alkyl groups containing 1 to 4 carbon atoms or a benzyl group, $R^{10}$ represents hydroxysubstituted alkyl groups containing 2 to 4 carbon atoms or a $CH_2CH_2NHCOR^8$ group and X stands for halide or alkyl sulfate. In one particular embodiment of the invention, products derived from oleic acid or from a fatty aced cut predominantly containing oleic acid are used. Quaternized fatty acid imidazolines obtained by condensation of oleic acid with diethylenetriamine or aminoethyl ethanolamine and subsequent quaternization with dimethyl sulfate or methyl chloride are particularly preferred. The ratio by weight of component (a) to component (b) in the textile finishes according to the invention may be from 90:10 to 10:90 and is preferably from 15:85 to 50:50 and more preferably, from 20:80 to 25:75.

Commercial Applications

The finishes according to the invention not only provide flat textiles, preferably blue denim cloth, with a pleasant soft feel, they also protect them reliably against yellowing. Accordingly, the present invention also relates to the use of the mixtures as finishes for simultaneously conditioning flat textiles and stabilizing them against yellowing. The finishes themselves are normally present in the form of aqueous solutions or pastes with an active substance content of 5 to 30% by weight. They may additionally contain electrolyte salts, for example, for adjusting viscosity.

EXAMPLES

Ozone stabilization was evaluated using blue denim cloth. The test substances were applied by the padding method: quantity used 30 g/l, 20° C., liquor uptake 70%, pH=5.5 to 6.5. They were absorbed in a horizontal washing machine: quantity used 4% by weight, based on the weight of the cloth (50° C., 20 mins., pH=5.5 to 6.5, liquor ratio 1:20). The evaluation is based on the ozone test according to AATCC 109-1992 using an ozone chamber of the TriC-03 type available from Textile Innovators Corp., USA. Ozone protection was evaluated against a grey standard; feel was determined in a panel test: 6=very good, 1=poor. The results are set out in Table 1 below. The following surfactants were used:

A1) methyl-quaternized fatty acid imidazoline obtained from oleic acid (iodine value 90 to 100) and aminoethyl ethanolamine in the form of the methyl sulfate salt;

A2) methyl-quaternized fatty acid imidazoline obtained from oleic acid (iodine value 85 to 90) and aminoethyl ethanolamine in the form of the methyl sulfate salt;

A3) methyl-quaternized fatty acid imidazoline obtained from tall oil fatty acid and aminoethyl ethanolamine in the form of the methyl sulfate salt;

B1) methyl-quaternized ditallow fatty acid triethanolamine ester in the form of the methyl sulfate salt.

TABLE 1

Discoloration and softness (quantities as % by weight)

| | R1 | R2 | R3 | R4 |
|---|---|---|---|---|
| Quat. fatty acid imidazoline A1 | 12.3 | — | — | — |
| Quat. fatty acid imidazoline A2 | — | 12.3 | — | — |
| Quat. fatty acid imidazoline A3 | — | — | 7.1 | — |
| Esterquat B1 | 3.2 | 3.2 | 8.4 | — |
| Water | | to 100 | | |
| Grey standard | 4.0 | 4.5 | 3.5 | 2.5 |
| Softness | 4.5 | 5.0 | 5.5 | 1.0 |

What is claimed is:

1. A textile finish composition for conditioning textiles and stabilizing them against yellowing comprising:

(a) an esterquat; and (b) a quaternized fatty acid imidazoline, wherein the esterquat and quaternized fatty acid imidazoline are present in the composition in a ratio by weight of from 15:85 to 50:50.

2. The composition of claim 1 wherein the esterquat corresponds to formula I:

(I)

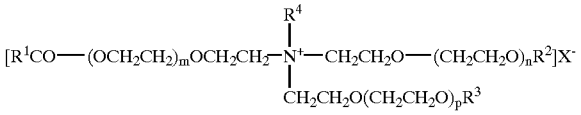

wherein $R^1CO$ is an acyl group containing from 6 to 22 carbon atoms, $R^2$ and $R^3$, independently of one another, represent hydrogen or have the same meaning as $R^1CO$, $R^4$ is an alkyl group containing from 1 to 4 carbon atoms or a $(CH_2CH_2O)_qH$ group, m, n and p, taken together, represent a number from 0 to 12, q is a number from 1 to 12 and X is a halide, an alkyl sulfate or an alkyl phosphate.

3. The composition of claim 1 wherein the esterquat corresponds to formula II:

(II)

$$[R^1CO-(OCH_2CH_2)_mOCH_2CH_2-\overset{\overset{R^4}{|}}{\underset{\underset{R^5}{|}}{N^+}}-CH_2CH_2O-(CH_2CH_2O)_nR^2]X^-$$

wherein $R^1CO$ is an acyl group containing from 6 to 22 carbon atoms, $R^2$ is hydrogen or has the same meaning as $R^1CO$, $R^4$ and $R^5$, independently of one another, are alkyl groups containing from 1 to 4 carbon atoms, m and n, taken together, represent a number from 0 to 12, and X is a halide, an alkyl sulfate or an alkyl phosphate.

4. The composition of claim 1 wherein the esterquat corresponds to formula III:

(III)

$$[R^4-\overset{\overset{R^6}{|}}{\underset{\underset{R^7}{|}}{N^+}}-CH_2\overset{\overset{O-(CH_2CH_2O)_mOCR^1}{|}}{C}HCH_2O-(CH_2CH_2O)_nR^2]X^-$$

wherein $R^1CO$ is an acyl group containing from 6 to 22 carbon atoms, $R^2$ is hydrogen or has the same meaning as $R^1CO$, $R^4$, $R^6$ and $R^7$ independently of one another, are alkyl groups containing from 1 to 4 carbon atoms, m and n, taken together, represent a number from 0 to 12, and X is a halide, an alkyl sulfate or an alkyl phosphate.

5. The composition of claim 2 wherein in formula I, $R^1CO$ is derived from tallow fatty acid.

6. The composition of claim 3 wherein in formula II, $R^1CO$ is derived from tallow fatty acid.

7. The composition of claim 4 wherein in formula III, $R^1CO$ is derived from tallow fatty acid.

8. The composition of claim 1 wherein the esterquat has an average degree of esterification of from 1.5 to 1.9.

9. A process for both imparting a soft feel onto, and inhibiting yellowing of, a textile substrate comprising contacting the textile substrate with a finish composition containing:

(a) an esterquat; and (b) a quaternized fatty acid imidazoline, wherein the esterquat and quatemized fatty acid imidazoline are present in the composition in a ratio by weight 90:10 to 10:90.

10. The process of claim 9 wherein the esterquat corresponds to formula I:

(I)

$$[R^1CO-(OCH_2CH_2)_mOCH_2CH_2-\overset{\overset{R^4}{|}}{\underset{\underset{CH_2CH_2O(CH_2CH_2O)_pR^3}{|}}{N^+}}-CH_2CH_2O-(CH_2CH_2O)_nR^2]X^-$$

wherein $R^1CO$ is an acyl group containing from 6 to 22 carbon atoms, $R^2$ and $R^3$, independently of one another, represent hydrogen or have the same meaning as $R^1CO$, $R^4$ is an alkyl group containing from 1 to 4 carbon atoms or a $(CH_2CH_2O)_qH$ group, m, n and p, taken together, represent a number from 0 to 12, q is a number from 1 to 12 and X is a halide, an alkyl sulfate or an alkyl phosphate.

11. The process of claim 9 wherein the esterquat corresponds to formula II:

(II)

$$[R^1CO-(OCH_2CH_2)_mOCH_2CH_2-\overset{\overset{R^4}{|}}{\underset{\underset{R^5}{|}}{N^+}}-CH_2CH_2O-(CH_2CH_2O)_nR^2]X^-$$

where $R^1CO$ is an acyl group containing from 6 to 22 carbon atoms, $R^2$ is hydrogen or has the same meaning as $R^1CO$, $R^4$ and $R^5$, independently of one another, are alkyl groups containing from 1 to 4 carbon atoms, m and n, taken together, represent a number from 0 to 12, and X is a halide, an alkyl sulfate or an alkyl phosphate.

12. The process of claim 9 wherein the esterquat corresponds to formula III:

(III)

$$[R^4-\overset{\overset{R^6}{|}}{\underset{\underset{R^7}{|}}{N^+}}-CH_2\overset{\overset{O-(CH_2CH_2O)_mOCR^1}{|}}{C}HCH_2O-(CH_2CH_2O)_nR^2]X^-$$

wherein $R^1CO$ is an acyl group containing from 6 to 22 carbon atoms, $R^2$ is hydrogen or has the same meaning as $R^1CO$, $R^4$, $R^6$ and $R^7$ independently of one another, are alkyl groups containing from 1 to 4 carbon atoms, m and n, taken together, represent a number from 0 to 12, and X is a halide, an alkyl sulfate or an alkyl phosphate.

13. The process of claim 10 wherein in formula I, $R^1CO$ is derived from tallow fatty acid.

14. The process of claim 11 wherein in formula II, $R^1CO$ is derived from tallow fatty acid.

15. The process of claim 12 wherein in formula III, $R^1CO$ is derived from tallow fatty acid.

16. The process of claim 9 wherein the esterquat has an average degree of esterification of from 1.5 to 1.9.

17. The process of claim 9 wherein the esterquat and the quatemized fatty acid imidazoline are present in the composition in a ratio by weight of from 15:85 to 50:50.

* * * * *